US005673682A

United States Patent [19]

Hannebaum

[11] Patent Number: 5,673,682

[45] Date of Patent: Oct. 7, 1997

[54] ROTATING AIR FIREPLACE

[76] Inventor: Harold W. Hannebaum, P.O. Box 437, Bellevue, Id. 83313

[21] Appl. No.: 510,713

[22] Filed: Aug. 3, 1995

[51] Int. Cl.[6] ..... F24B 1/181

[52] U.S. Cl. ..... 126/519; 126/533; 126/536

[58] Field of Search ..... 126/519, 533, 126/534, 535, 537, 540, 536

[56] References Cited

U.S. PATENT DOCUMENTS

| | | | |
|---|---|---|---|
| 3,381,678 | 5/1968 | Fry | 126/4 |
| 3,499,432 | 3/1970 | Hannebaum | 126/519 |
| 3,986,488 | 10/1976 | Hannebaum | 126/506 |
| 4,076,009 | 2/1978 | Hannebaum | 126/515 |
| 4,181,117 | 1/1980 | Hannebaum | 126/519 |
| 4,273,096 | 6/1981 | Hannebaum | 126/519 |
| 4,332,235 | 6/1982 | Hannebaum | 126/515 |

OTHER PUBLICATIONS

Marketing Brochure of Malm Fireplaces, Carousel Design, Malm fireplaces, Inc., 368 Yolanda Ave., Santa Roas, CA 95404; Refers to U.S. Pat. No. 3,499,432 to Hannebaum (item No. 6 above).

*Primary Examiner*—Larry Jones
*Attorney, Agent, or Firm*—Craig M. Korfanta

[57] ABSTRACT

An rotating air fireplace comprising a pedestal section, a fire enclosure, a truncated conical hood, and an adjustable baffle assembly. Adjusting the position of the baffle alters the inlet and outlet annular vortex and the size and intensity of the fire. Air is drawn into the fire chamber through an air inlet means located along the top end of the cylindrical fire enclosure. An air directing means is aligned with the air inlet means to impart a downward tangential flow through the fire enclosure that keeps the glass fire enclosure cool and clean. A free standing wood holding means rests on the pedestal section and is centered within the fire enclosure.

12 Claims, 5 Drawing Sheets

ROTATING AIR FIREPLACE

BACKGROUND OF THE INVENTION

1. Field of Invention

This invention relates generally to fireplaces and stoves. More specifically, it relates to a rotating air, glass-walled fireplace having an adjustable baffle assembly, an air inlet means near the top end of the fireplace wall, and a wood holder.

2. Description of Prior Art

U.S. Pat. No. 3,499,432 (Hannebaum '432) discloses a freestanding heating unit having a fixed fire spreader, or baffle. In the unit, selected glass panes define a plurality of elongated, vertical air intake openings extending the entire length of the panes. The unit also has a concentric ring mounted on the top end of the glass panes to prevent inlet air from adding to the updraft and heated air from circling against the glass sidewalls.

U.S. Pat. No. 4,181,117 (Hannebaum '117) discloses a fireplace heating unit having adjustable louvers mounted on the border of the outlet hood. The louvers are flat vanes oriented over a series of openings to force the air flowing into the interior of the heating unit in a downward direction.

U.S. Pat. No. 4,273,096 (Hannebaum '096) discloses a fireplace heating unit having a top section with a horizontal peripheral border. Integral with the border is a plurality of openings that are partially blocked by louvers. Hinged flaps are attached outside the louvers to control the amount of air passing into the heating unit. The louvers are in the form of a flat vane and cause the inlet air to swirl into the fire place along the inner surface of the glass. Hannebaum '096 discloses an embodiment wherein the top section is displaced from the frame to form a peripheral air intake slot. Each slot is partially blocked by a continuous vane shaped in a way to deflect the vertical flow of intake air into a horizontal clockwise flow.

U.S. Pat. No. 4,332,235 (Hannebaum '235) discloses an enclosed fireplace mounted on a pedestal. The fireplace has a plurality of vertical air intake tubes drawing air from the base of the pedestal. Also, the fireplace has a wood holder comprising a series of horizontal rings and vane shaped legs. Each leg has a flat, thin, generally vertical strip, the primary purpose of which is to direct air approaching the wood holder into a specific rotational flow within the wood holder.

SUMMARY OF THE INVENTION

The present invention is a rotating air, glass-walled fireplace comprising a cylindrical fire enclosure, a truncated conical hood, and an adjustable baffle assembly. Adjusting the position of the baffle alters the inlet and outlet annular vortices and, consequently, the diameter and height of the fire. Air is drawn into the cylindrical fire enclosure through an air inlet means located along the top end of the wall of the fire enclosure. An air directing means is aligned with the air inlet means to impart a tangential flow along the inside of the fire enclosure that keeps the fire enclosure's glass sidewalls cool and clean. A free standing wood holding means rests on the bottom center of the fire enclosure. The wood holding means comprises a vertical series of horizontal rings joined by a plurality of hollow, vertical legs with apertures near their lower end.

BRIEF DESCRIPTION OF THE DRAWINGS

FIG. 2 also shows the extreme positions of the draft door and a top view of the air flow through the fire enclosure of the invention.

FIG. 5 also shows the air flow within the fire enclosure during use of the invention.

DESCRIPTION OF THE PREFERRED EMBODIMENT

Figure 5:
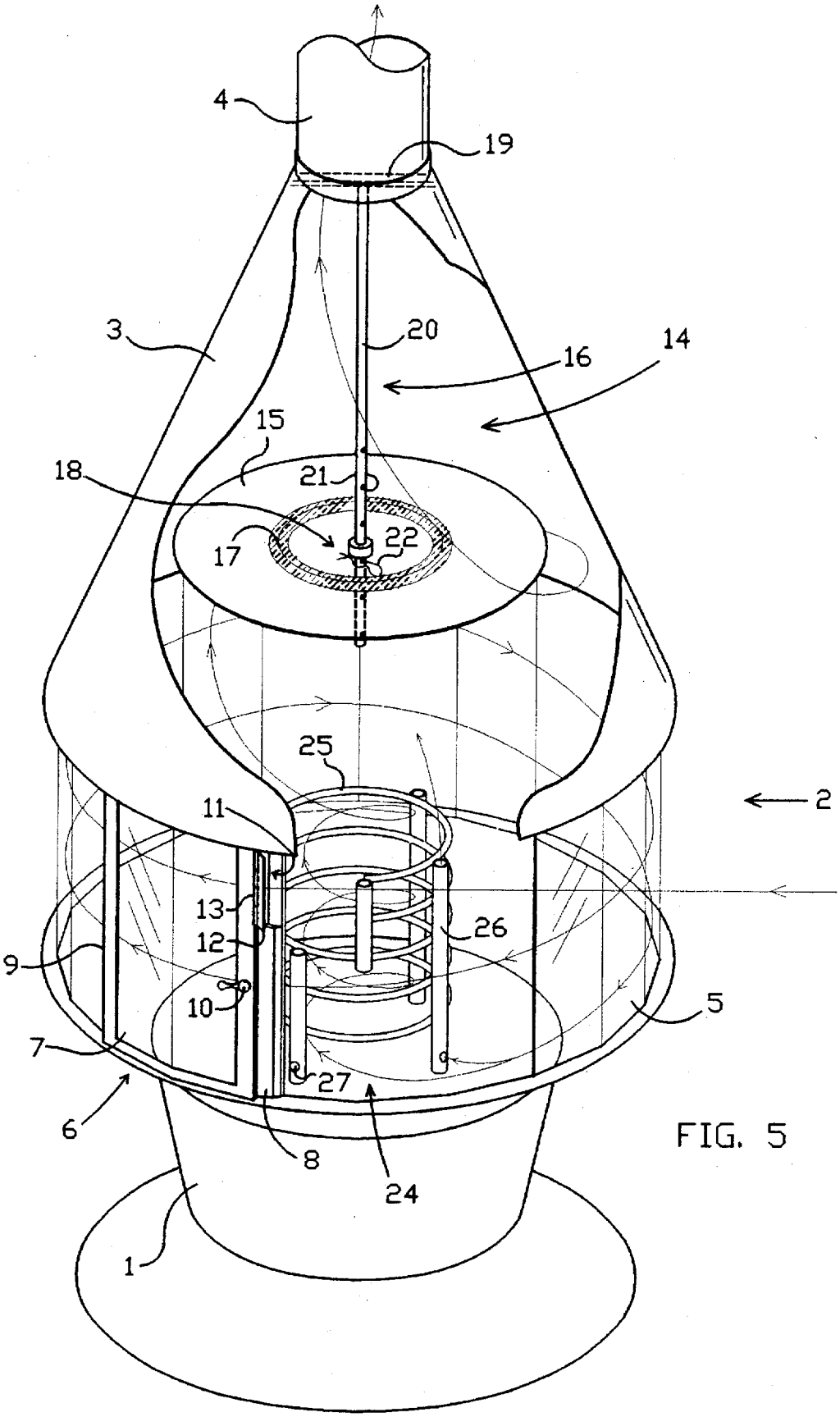
FIG. 5 is a perspective, partial cross-sectional view showing the draft door in the open position.

Referring to the figures, the fireplace which is one embodiment of the present invention comprises a pedestal section 1, a fire enclosure 2, and a conical metal hood 3. (See FIGS. 1 & 5) The truncated conical hood 3 has a large and a small end. The large end of the conical hood 3 is fixedly connected to the top end of the fire enclosure 2. The small end of the conical hood 3 is attached to a flue pipe 4.

The fire enclosure 2 is formed by a series of transparent, vertical side walls comprising windows 5 and a fuel door assembly 6. (See FIG. 1 ) The vertical side walls of the fire enclosure 2 form a generally cylindric shape and are joined at their common vertical edges with a sealing material. The cylindrical fire enclosure 2 has a top and bottom end. The bottom end of the fire enclosure 2 is mounted on the pedestal section 1.

The fuel door assembly 6 comprises a fuel door 7, a door seal 8, a pivot means 9, and a door opening means 10. (See FIGS. 1 & 2) The fuel door 7 is attached to one of the vertical side walls by a conventional pivot means 9, such as at least one vertical hinge. The fuel door 7 opens outward and rotates about a vertical axis of the vertical hinge. The door seal 8 surrounds the fuel door 7 and forms a seal when the door 7 is closed. The fuel door opening means 10 may be a door handle and a latch. The specific form is not important. However, there must be a way to open and securely close the fuel door 7.

Figure 1:
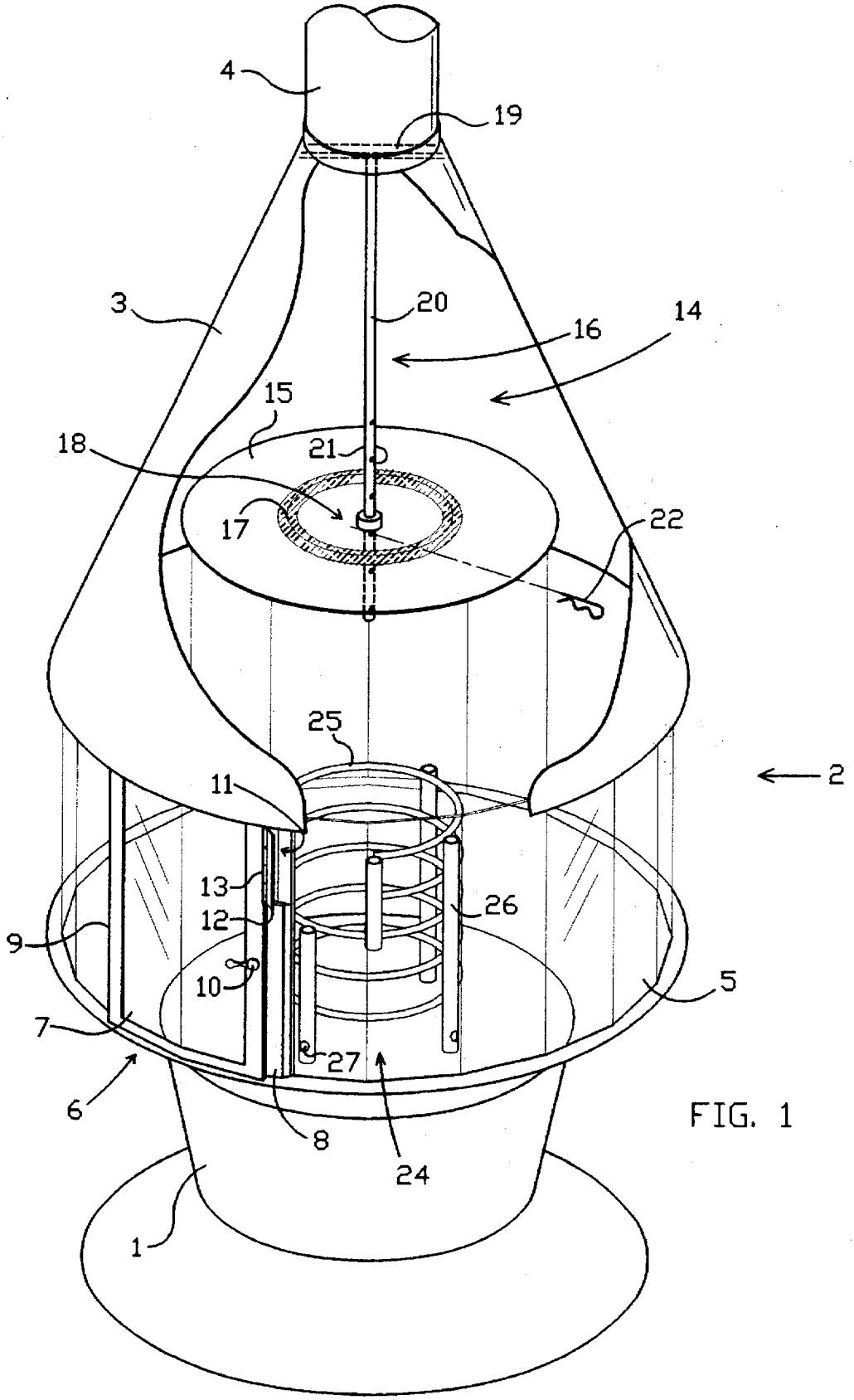
FIG. 1 is a perspective, partial cross-sectional view of one embodiment of the invention.
Figure 2:
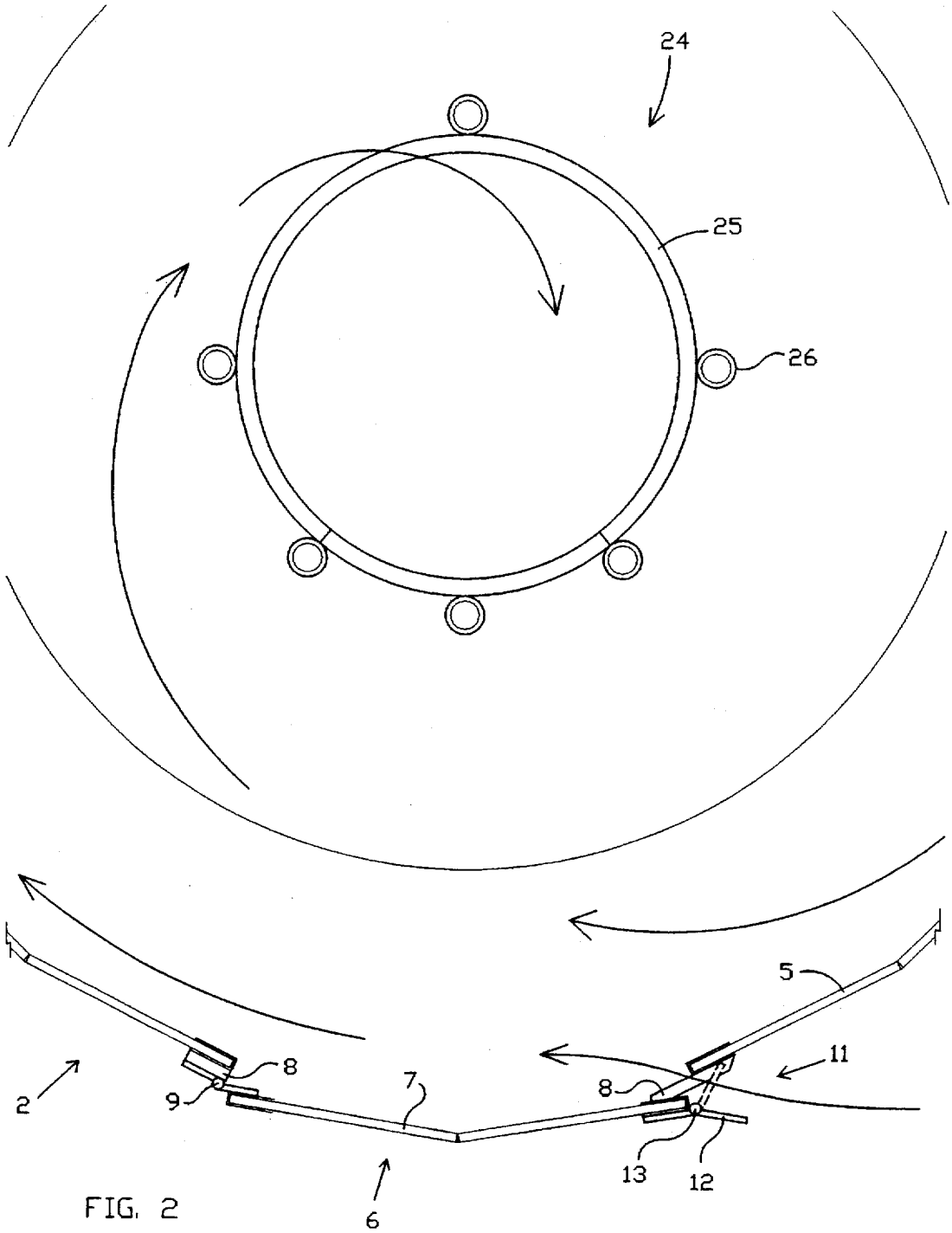
FIG. 2 is a top, partial cross-sectional view of one embodiment of the invention showing the wood holder, fuel door, and draft door.
Figure 4:
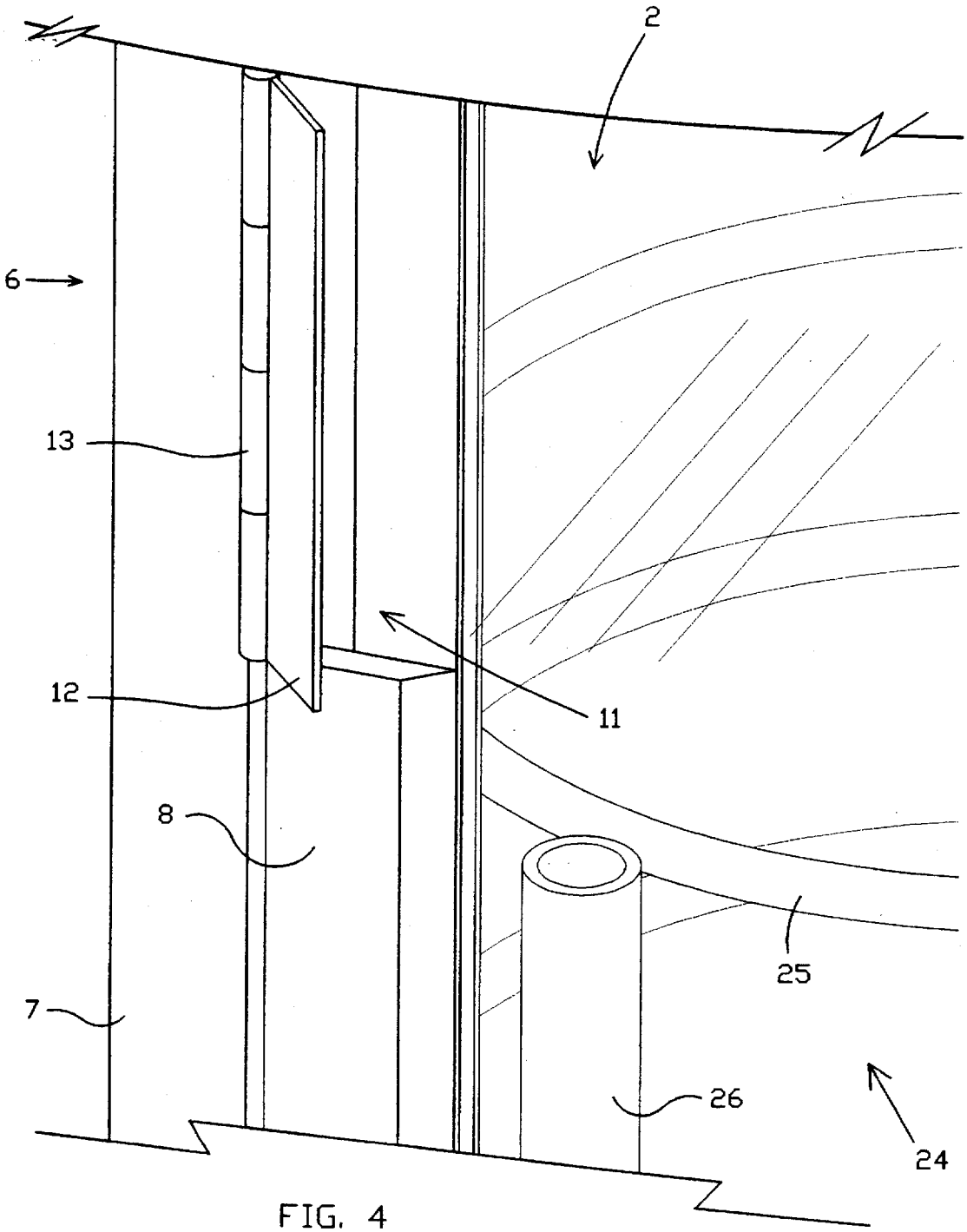
FIG. 4 is a perspective, detail view of the draft door of one embodiment of the invention in the open position.

As shown generally in FIGS. 1 and 2, at least one air inlet means 11 is located at or near the top end of the fire enclosure 2. The preferred air inlet means 11 is pivotally mounted to the fuel door 7 and comprises a draft door 12 and at least one hinge 13. (See FIGS. 2 & 4) The draft door 12 pivots about a vertical axis of the hinge 13 and opens in an outward direction. (See FIG. 2) In this embodiment, the draft door 12 actually forms part of the fuel door assembly 6.

Other embodiments of an air inlet means 11 are possible and can perform the same function. For example, a cut-out between one or more of the vertical side walls forming the fire enclosure 2 will work. The cutout is located at or near the top end of the fire enclosure 2 and would extend downward only a short distance. The top end of the fire enclosure 2 is defined to be the top 35%. Therefore, the only requirement that the location of the air inlet means 11 must meet is that it be at or near the top end, or within the top 35%, of the fire enclosure 2. Having the air inlet means 11 at or near the top end of the fire enclosure 2 ensures that the inlet air stays next to the windows 5 and keeps the inlet and outlet air separate.

In the preferred embodiment, the draft door 12 also acts as an air directing means that imparts a circular motion to the air entering through the air inlet means 11. The air directing means causes the inlet air to enter the fire enclosure 2 in a downward rotational direction. The aerodynamics of the fire causes the cool inlet air to flow downwardly towards the back of the fire. This, plus the rotational flow caused by the air directing means, causes the inlet air to travel around and down along the glass sidewalls of the fire enclosure 2. As the fuel burns, the outlet air flows in a rotating upwardly direction separate from the inlet air. Any air directing means must be aligned with the air inlet means 11 so it can impart the tangential or rotational flow to the inlet air.

Attached to the inside surface of the conical metal hood 3 is an adjustable baffle assembly 14. (See FIG. 1) The adjustable baffle assembly 14 comprises a baffle plate 15, a baffle support means 16, a splatter ring 17, and a baffle adjusting means 18. The baffle support means 16 comprises an elongated horizontal member 19 and a downwardly extending elongated pipe 20. The elongated pipe 20 is hollow and has two ends. The top or first end is pivotally attached to the horizontal member 19. The bottom or second end of the elongated pipe 20 is connected to a baffle plate 15.

The preferred embodiment of the invention has a series of apertures 21 at the second end of the elongated pipe 20 for receiving a pin 22 which secures the slideably attached baffle plate 15 at the desired vertical height. Changing the vertical position of the baffle plate 15 enables the user to adjust the inlet and outlet vortex of the moving air and affects the diameter and height of the fire. The adjustment is usually made only once when the fireplace is initially installed. The adjustment enables the owner to adjust the vertical height of the baffle plate 15 as required by the unique chimney and flue pipe at that particular site. The baffle plate 15 is a horizontal disk. A splatter ring 17 made of melted spun glass, for example, is mounted on the top of the baffle plate 15 and catches any condensation from the hood 3 without splashing and spotting the side walls of the fire enclosure 2.

The adjustable baffle assembly enables each owner to adjust the vertical position of the baffle plate, as required, depending on the condition and type of chimney and flue pipe that is in place, to achieve the desired diameter and height of fire.

Figure 3:
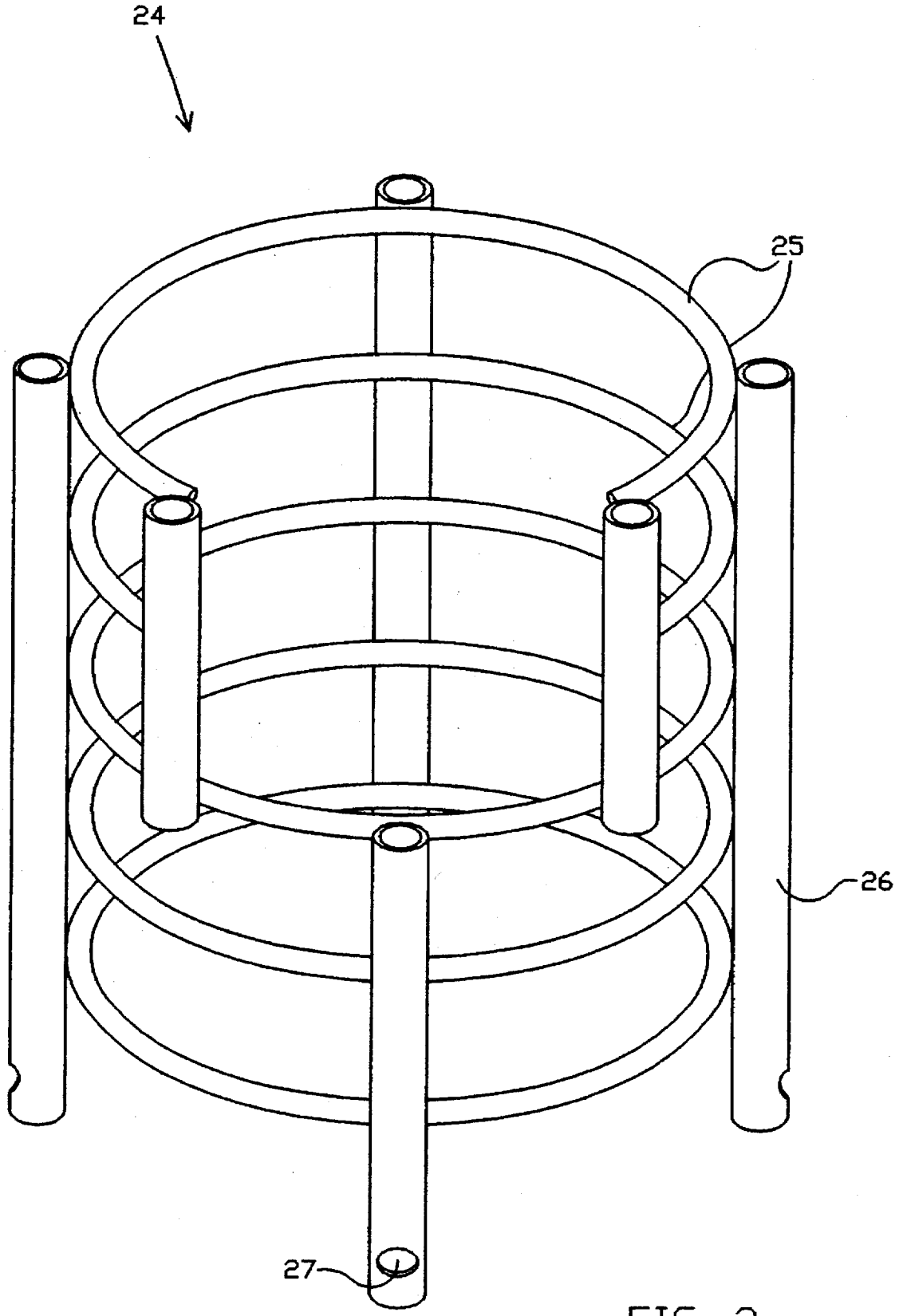
FIG. 3 is a perspective, detail view of the wood holder of one embodiment of the invention.

Centered in the fire enclosure 2 is a wood holding means 24. (See FIGS. 1–3) The preferred wood holder is formed by a plurality of spaced horizontal rings 25. The rings 25 are attached to a plurality of legs 26 at their outside edges by conventional means such as welding. The position of the legs 26 is not important as long as the rings 25 are concentric and spaced. The preferred legs 26 are elongated hollow pipes. However, the shape or hollowness of the legs 26 is not crucial because their primary purpose is only as support members and not as the air directing means 14 that must impart a tangential flow to the inlet air. In the preferred embodiment, each leg 26 has an aperture 27 in the side wall near the bottom end of the pipe. When the legs 26 are attached to the concentric, horizontal rings 25, the aperture 27 faces outward allowing air to flow into the pipe through the opening at the bottom end of the leg 26 and out the top end. The legs 26 may be rotated so that the aperture 27 is in line with the rotational air flow. The air flow cools the wood holding means 24 by drawing heat away from the metal rings 25 and legs 26 and, as a result, reducing the stresses within the metal components forming the wood holder 24. By reducing the stresses, the wood holder 24 retains its shape and has a longer life. In use, the wood holder contains the pieces of wood in a vertical position. Its capacity is limited only by the size of the concentric rings.

The present invention addresses the shortcomings of the prior art. Hannebaum '432 discloses a heating unit having air inlets between some of the panes that extended the entire length of the panes. The current invention utilizes air inlet means only at or near the top end of the fire enclosure which increases the velocity of the inlet air, and which causes the inlet air to flow in a downwardly tangential direction against the fire enclosure. In addition, the increased velocity and downward tangential flow of the inlet air is more efficient at keeping the fire enclosure windows clean and cool.

Hannebaum '432 also discloses a concentric ring mounted on the top end of the glass panes that was intended to keep the inlet and outlet air flow separate. This concentric ring, however, was ineffective for maintaining separate and distinct flows for the inlet and outlet air. In the present invention, the location and type of air inlet means solves the problem of mixing the inlet and outlet air that occurred in the prior art.

Hannebaum '235 discloses a wood holder having spaced concentric rings supported by a plurality of legs. The legs have thin, generally vertical strips which have the primary function of directing the inlet air into a tangential flow within the wood holder. These vertical strips, or fins, however, cause the wood holder to be bulky and inconvenient. The disclosed invention uses a wood holder without fins, and with hollow legs having an aperture near their bottom ends. The aperture enables air to flow through the hollow legs cooling the metal wood holder and reducing the stresses on its metal components.

In addition, the fin shaped legs limit the size of the concentric rings and, consequently, the capacity of the wood holder so that the holder can fit in to the fire enclosure. The disclosed wood holder can use larger concentric rings because it has smaller hollow legs. Consequently, the wood holder has a greater capacity for wood than the one disclosed in Hannebaum '235.

Although this invention has been described above with reference to particular means, materials and embodiments, it is to be understood that the invention is not limited to these disclosed particulars, but extends instead to all equivalents within the scope of the following claims.

What is claimed is:

1. An enclosed fireplace, comprising:

a. a substantially cylindrical fire enclosure, said fire enclosure having first and second ends, said first end of said fire enclosure being the bottom end and being closed, said second end of said fire enclosure being the top end and being open, said fire enclosure further comprising a wall of said fire enclosure between its first and second ends, said wall having a fuel door assembly;

b. coupling means, attached to and extending upward from said open second end of said fire enclosure, for coupling said fire enclosure to a chimney, said coupling means having a larger, open lower end and a smaller, open upper end, said larger lower end of said coupling means being attached to said open, second end of said fire enclosure, said smaller upper end of said coupling means allowing combustion products to flow upward and exit said coupling means, said coupling means having an inside and outside surface defining a tapered interior volume of said coupling means; and, c. an adjustable baffle assembly disposed generally within said tapered interior volume of said coupling means, said adjustable baffle comprising a horizontal plate which is vertically adjustable generally within said interior volume of said coupling means.

2. An enclosed fireplace, as recited in claim 1, wherein:

a. said horizontal plate is disposed within said interior volume of said coupling means by a support means further comprising a vertical hollow pipe extending downwardly from a horizontal bracing member, and supporting said horizontal plate; and, b. said horizontal plate further having a top and bottom surface.

3. An enclosed fireplace, comprising:

a. a substantially cylindrical fire enclosure, said fire enclosure having first and second ends, said first end of said fire enclosure being the bottom end and being closed, said second end of said fire enclosure being the top end and being open, said fire enclosure further comprising a wall of said fire enclosure between its first and second ends, said wall having a fuel door assembly;

b. coupling means, attached to and extending upward from said open second end of said fire enclosure, for coupling said fire enclosure to a chimney, said coupling means having a larger, open lower end and a smaller, open upper end, said larger lower end of said coupling means being attached to said open, second end of said fire enclosure, said smaller upper end of said coupling means allowing combustion products to flow upward and exit said coupling means, said coupling means having an inside and outside surface defining a tapered interior volume of said coupling means;

c. an adjustable baffle assembly disposed generally within said tapered interior volume of said coupling means, said adjustable baffle comprising a horizontal plate which is vertically adjustable generally within said interior volume of said coupling means;

d. said horizontal plate is disposed within said interior volume of said coupling means by a support means further comprising a vertical hollow pipe extending downwardly from a horizontal bracing member, and supporting said horizontal plate;

e. said horizontal plate further having a top and bottom surface; and f. said hollow pipe has a first and second end, said first end being the top end and being attached to said horizontal member, and said second end being the bottom end and being slideably attached to said horizontal plate.

4. An enclosed fireplace, comprising:

a. a substantially cylindrical fire enclosure, said fire enclosure having first and second ends, said first end of said fire enclosure being the bottom end and being closed, said second end of said fire enclosure being the top end and being open, said fire enclosure further comprising a wall of said fire enclosure between its first and second ends, said wall having a fuel door assembly;

b. coupling means, attached to and extending upward from said open second end of said fire enclosure, for coupling said fire enclosure to a chimney, said coupling means having a larger, open lower end and a smaller, open upper end, said larger lower end of said coupling means being attached to said open, second end of said fire enclosure, said smaller upper end of said coupling means allowing combustion products to flow upward and exit said coupling means, said coupling means having an inside and outside surface defining a tapered interior volume of said coupling means;

c. an adjustable baffle assembly disposed generally within said tapered interior volume of said coupling means, said adjustable baffle comprising a horizontal plate which is vertically adjustable generally within said interior volume of said coupling means; and d. said horizontal plate comprises a splatter ring with a porous upper surface mounted on said top surface of said horizontal plate.

5. An enclosed fireplace, as recited in claim 4, further comprising:

a. air inlet means, near said second end of said fire enclosure, for allowing inlet air into said fire enclosure, and;

b. air directing means, aligned with said air inlet means, for directing said inlet air into said fire enclosure, said air directing means being positioned to impart a tangential flow to the inlet air.

6. An enclosed fireplace, as recited in claim 5, wherein:

a. said air inlet means being part of said fuel door assembly, said air inlet means further comprising a draft door pivotally attached to said fuel door assembly; and, b. said air directing means also comprises said draft door.

7. An enclosed fireplace, as recited in claim 6, further comprising a wood holding means, placed on the top surface of the first closed end of said fire enclosure, for holding fire wood in a vertical position.

8. An enclosed fireplace, as recited in claim 7, wherein said wood holding means further comprises:

a. a plurality of spaced circumferential rings;

b. a plurality of spaced hollow vertical legs fixedly attached to said rings, said vertical legs having a first bottom end and a second top end and wall, said vertical legs further having a sidewall, said legs having an aperture in said sidewall near said first end of said leg.

9. An enclosed fireplace, consisting essentially of:

a. a substantially cylindrical fire enclosure, said fire enclosure having first and second ends, said first end of said fire enclosure being the bottom end and being closed, said second end of said fire enclosure being the top end and being open, said fire enclosure further comprising a wall of said fire enclosure between its first and second ends, said wall having a fuel door assembly;

b. coupling means, attached to and extending upward from said open second end of said fire enclosure, for coupling said fire enclosure to a chimney, said coupling means having a larger, open lower end and a smaller, open upper end, said larger lower end of said coupling means being attached to said open, second end of said fire enclosure, said smaller upper end of said coupling means allowing combustion products to flow upward and exit said coupling means, said coupling means having an inside and outside surface defining a tapered interior volume of said coupling means; and, c. air inlet means, said air inlet means being only located near said second end of said fire enclosure, for allowing inlet air into said fire enclosure only from the top end of said enclosure; and d. air directing means, aligned with said air inlet means, for directing said inlet air into said fire enclosure, said air directing means being positioned to impart a tangential flow to the inlet air.

10. An enclosed fireplace, comprising:

a. a substantially cylindrical fire enclosure, said fire enclosure having first and second ends, said first end of said fire enclosure being the bottom end and being closed, said second end of said fire enclosure being the top end and being open, said fire enclosure further comprising a wall of said fire enclosure between its first and second ends, said wall having a fuel door assembly;

b. coupling means, attached to and extending upward from said open second end of said fire enclosure, fog coupling said fire enclosure to a chimney, said coupling means having a larger, open lower end and a smaller, open upper end, said larger lower end of said coupling means being attached to said open, second end of said fire enclosure, said smaller upper end of said coupling means allowing combustion products to flow upward and exit said coupling means, said coupling means having an inside and outside surface defining a tapered interior volume of said coupling means;

c. air inlet means, near said second end of said fire enclosure, for allowing inlet air into said fire enclosure;

d. air directing means, aligned with said air inlet means, for directing said inlet air into said fire enclosure, said air directing means being positioned to impart a tangential flow to the inlet air; and e. said air inlet means being part of said fuel door assembly, said air inlet means further comprising a draft door pivotally attached to said fuel door assembly; and, f. said air directing means also comprises said draft door.

11. An enclosed fireplace, as recited in claim 10, further comprising a wood holding means, placed on the top surface of the first closed end of said fire enclosure, for holding fire wood in a vertical position.

12. An enclosed fireplace, as recited in claim 11, wherein said wood holding means further comprises:

a. a plurality of vertically spaced horizontal rings;

b. a plurality of spaced hollow vertical legs fixedly attached to said rings, said vertical legs having a first bottom end and a second top end, said vertical legs further having a sidewall, said legs having an aperture in said sidewall near said first end of said leg.

* * * * *